US010561252B2

(12) United States Patent
Choi

(10) Patent No.: US 10,561,252 B2
(45) Date of Patent: Feb. 18, 2020

(54) FOLDABLE BED FRAME

(71) Applicant: Inno-Sports Co., Ltd., Xiamen (CN)

(72) Inventor: Kwan Jun Choi, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 200 days.

(21) Appl. No.: 15/820,754

(22) Filed: Nov. 22, 2017

(65) Prior Publication Data

US 2018/0332973 A1 Nov. 22, 2018

(30) Foreign Application Priority Data

May 17, 2017 (CN) ..... 2017 2 0546279 U

(51) Int. Cl.
*A47C 19/12* (2006.01)
*A47C 19/02* (2006.01)

(52) U.S. Cl.
CPC ..... *A47C 19/12* (2013.01); *A47C 19/024* (2013.01); *A47C 19/025* (2013.01)

(58) Field of Classification Search
CPC ..... A61G 1/013; A61G 1/0562; A47B 3/08; A47B 3/087; A47B 3/083; A47B 3/0911; A47B 3/0915; A47C 17/70; A47C 19/024; A47C 19/021; A47C 19/12; A47C 19/122
See application file for complete search history.

(56) References Cited

U.S. PATENT DOCUMENTS 190,338 A 5/1877 Hall
261,770 A 7/1882 Segar
478,761 A 7/1892 Rodecap
605,126 A 6/1898 Odell
767,680 A 8/1904 Barton
802,390 A 10/1905 Gusdorf
1,070,525 A 8/1913 Pieper
1,196,253 A 8/1916 Lowy
1,218,868 A * 3/1917 Jones ..... A47C 19/122 5/111
1,259,825 A 3/1918 Basile
1,360,983 A 11/1920 Burton
1,367,173 A 2/1921 Berta
1,530,726 A 3/1925 Koenigkramer
1,574,659 A 2/1926 Johnston
2,513,168 A 6/1950 Gottlieb
(Continued)

OTHER PUBLICATIONS

U.S. Appl. No. 15/144,575, filed May 2, 2016.
(Continued)

*Primary Examiner* — Nicholas F Polito
*Assistant Examiner* — Adam C Ortiz
(74) *Attorney, Agent, or Firm* — Morgan, Lewis & Bockius LLP

(57) ABSTRACT

A foldable bed frame includes pivotally connected bedsteads. A bedstead includes an upper frame and a side leg assembly pivotally connected with the upper frame. A bedstead also includes one or more oblique supports each pivotally connected with the upper frame and slidably and rotatably connected with the side leg assembly. A bedstead further includes a "⊏" shaped lower peripheral support and a plurality of links connecting the lower peripheral support with the upper frame and the side leg assembly. The lower peripheral support can be folded and unfolded along with the upper frame and the side leg assembly.

12 Claims, 4 Drawing Sheets

(56) References Cited

U.S. PATENT DOCUMENTS

| | | | | |
|---|---|---|---|---|
| 2,651,787 | A | 9/1953 | Piliero | |
| 2,671,229 | A | 3/1954 | Vernier | |
| 2,678,085 | A | 5/1954 | De Minno | |
| 2,701,603 | A | 2/1955 | Coopersmith | |
| 2,782,075 | A | 2/1957 | Fagan | |
| 2,888,688 | A | 6/1959 | Bereman | |
| 3,108,291 | A | 10/1963 | Eason | |
| 3,245,363 | A | 4/1966 | Kanitz | |
| 3,295,149 | A | 1/1967 | Hall | |
| 3,967,330 | A | 7/1976 | Zawadowsky | |
| 4,048,683 | A | 9/1977 | Chen | |
| 4,594,743 | A | 6/1986 | Owen | |
| 4,620,336 | A | 11/1986 | Miller | |
| 4,654,905 | A | 4/1987 | Miller | |
| 5,517,744 | A | 5/1996 | Moser | |
| 5,608,930 | A | 3/1997 | Chen | |
| 5,894,614 | A | 4/1999 | Stroud | |
| 6,151,730 | A | 11/2000 | Weston | |
| 6,230,344 | B1 * | 5/2001 | Thompson | A47C 19/045 5/611 |
| 6,643,900 | B2 | 11/2003 | Jahrling | |
| 7,376,989 | B2 | 5/2008 | Wickstrom | |
| 7,406,727 | B2 | 8/2008 | Wickstrom | |
| 7,503,086 | B2 | 3/2009 | Wickstrom | |
| 8,312,576 | B1 | 11/2012 | Oh | |
| 8,370,973 | B1 * | 2/2013 | Oh | A47C 23/005 5/250 |
| 8,707,478 | B2 | 4/2014 | Jin | |
| 8,769,740 | B2 | 7/2014 | Oh | |
| 8,898,832 | B2 | 12/2014 | Oh | |
| 8,978,176 | B1 | 3/2015 | Oh | |
| 9,027,181 | B1 | 5/2015 | Yu | |
| 9,226,590 | B1 | 1/2016 | Hull et al. | |
| 9,314,386 | B1 | 4/2016 | Boyd | |
| 9,456,699 | B1 | 10/2016 | Oh | |
| 9,526,347 | B2 | 12/2016 | Boyd | |
| 9,538,850 | B2 | 1/2017 | Oh | |
| 9,907,405 | B2 | 3/2018 | An | |
| 10,034,551 | B2 | 7/2018 | Hull | |
| 10,123,629 | B2 | 11/2018 | Choi | |
| 10,285,506 | B2 | 5/2019 | Choi | |
| 2003/0039506 | A1 | 2/2003 | Chen | |
| 2005/0251911 | A1 | 11/2005 | Wickstrom | |
| 2006/0195982 | A1 | 9/2006 | Cloer | |
| 2006/0230532 | A1 | 10/2006 | Wickstrom | |
| 2008/0000024 | A1 | 1/2008 | Peixin | |
| 2009/0133191 | A1 | 5/2009 | Harrow | |
| 2009/0293193 | A1 | 12/2009 | Neatherry | |
| 2010/0115696 | A1 | 5/2010 | Felix, Jr. | |
| 2010/0235989 | A1 | 9/2010 | Jin | |
| 2010/0299831 | A1 | 12/2010 | Lee | |
| 2011/0073723 | A1 | 3/2011 | Ashpole | |
| 2011/0099712 | A1 | 5/2011 | Jin | |
| 2012/0042449 | A1 | 2/2012 | Hull | |
| 2012/0222216 | A1 | 9/2012 | Jin | |
| 2012/0246826 | A1 | 10/2012 | Jin | |
| 2013/0067659 | A1 | 3/2013 | Oh | |
| 2013/0067862 | A1 | 3/2013 | Oh | |
| 2013/0276229 | A1 | 10/2013 | Hsieh | |
| 2014/0345044 | A1 | 11/2014 | Murphy | |
| 2015/0143630 | A1 | 5/2015 | Harrow | |
| 2015/0320225 | A1 | 11/2015 | Boyd | |
| 2016/0143447 | A1 | 5/2016 | Oh | |
| 2016/0206112 | A1 | 7/2016 | Oh | |
| 2016/0262547 | A1 | 9/2016 | Jin | |
| 2016/0281770 | A1 | 9/2016 | Vankoughnett | |
| 2016/0302582 | A1 | 10/2016 | Oh | |
| 2016/0302583 | A1 | 10/2016 | Oh | |
| 2016/0316922 | A1 | 11/2016 | Choi | |
| 2017/0119166 | A1 | 5/2017 | An | |
| 2017/0325592 | A1 * | 11/2017 | Suh | A47C 20/041 |
| 2018/0116412 | A1 | 5/2018 | Jin | |
| 2019/0045938 | A1 | 2/2019 | Skaggs | |

OTHER PUBLICATIONS

U.S. Appl. No. 15/144,471, filed May 2, 2016.
U.S. Appl. No. 15/056,150, filed Nov. Feb. 29, 2016.
U.S. Appl. No. 15/820,848, filed Nov. 22, 2017.
U.S. Appl. No. 15/423,251, filed Feb. 2, 2017.
U.S. Appl. No. 15/640,810, filed Jul. 3, 2017.
U.S. Appl. No. 15/663,522, filed Jul. 28, 2017.
U.S. Appl. No. 15/809,161, filed Nov. 10, 2017.

* cited by examiner

FOLDABLE BED FRAME

CROSS-REFERENCE TO RELATED APPLICATIONS

The present application claims priority to Chinese Utility Model Application CN 201720546279.2 filed May 17, 2017. The disclosure of the application is incorporated herein for all purposes by reference in its entirety.

FIELD OF THE INVENTION

The present invention generally relates to bed frames and their components. More particularly, the present invention relates to supports and foldable bed frames having such supports.

BACKGROUND

Generally, a foldable bed frame includes two pivotally connected upper frames, and legs pivotally connected with and supporting the upper frames. To stabilize the foldable bed frame, legs are usually connected with each other by lateral bars, and legs/lateral bars are connected with upper frames by supports. In some existing foldable bed frames, supports are made of telescopically coupled bars, with push buttons to unlock the bars so that the bed frames can be folded. In many cases, one has to push the buttons very hard to unlock the bars, making the foldable bed frames inconvenient to use.

Some existing foldable bed frames also include bedding supports configured to be attached to the bed frames after the bed frames are unfolded. Such bedding supports usually work separately and independently, e.g., they cannot be folded or unfolded along with the other components of the bed frames while connected with the bed frames. They have to be detached and removed from the bed frames in order to fold and unfold the bed frames. It is inconvenient and time consuming.

Given the current state of the art, there remains a need for supports and foldable bed frames that address the above-mentioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides supports and foldable bed frames that are ease to fold and unfold, and stable in use.

In various exemplary embodiments, the present invention provides a foldable bed frame including first and second bedsteads, and a middle leg assembly disposed between the first and second bedsteads and pivotally connecting the first and second bedsteads. Each of the first and second bedsteads includes an upper frame, a side leg assembly, a lower peripheral support and a plurality of links. The upper frame has a proximal side and a distal side. The side leg assembly is pivotally connected with the upper frame at the distal side. The lower peripheral support has a substantially "⊏" shape and includes a left segment, a right segment, and a lateral segment between the left and right segments. When the foldable bed frame is unfolded, the lower peripheral support is disposed below the upper frame with the lateral segment at the distal side of the upper frame, the left segment at a left side of the side leg assembly, and the right segment at a right side of the side leg assembly. The plurality of links includes a first left link, a second left link, a first right link, a second right link and a middle link. The first left link pivotally connects a free end portion of the left segment of the lower peripheral support with the upper frame. The second left link pivotally connects a middle portion of the left segment of the lower peripheral support with the side leg assembly. The first right link pivotally connects a free end portion of the right segment of the lower peripheral support with the upper frame. The second right link pivotally connects a middle portion of the right segment of the lower peripheral support with the side leg assembly. The middle link pivotally connects a middle portion of the lateral segment of the lower peripheral support with the side leg assembly.

The middle leg assembly is disposed between the first and second bedsteads and pivotally connects the proximal side of the upper frame of the first bedstead with the proximal side of the upper frame of the second bedstead. In an exemplary embodiment, the proximal side of the upper frame of each bedstead is pivotally connected with the middle leg assembly.

In some exemplary embodiments, each of the first and second bedsteads further includes one or more oblique supports, each having a first end portion pivotally connected with the upper frame, and a second end portion slidably and rotatably connected with the side leg assembly. Each oblique support is selectively locked at a position thereby restricting the side leg assembly from rotating with respect to the upper frame.

In some exemplary embodiments, the first left or right link has a first end portion pivotally connected with the free end portion of the left or right segment of the lower peripheral support, and a second end portion pivotally connected with a left or right edge of the upper frame. In an exemplary embodiment, the first end portion of the first left or right link is pivotally connected with a connecting piece fixedly coupled with the free end portion of the left or right segment of the lower peripheral support.

In many exemplary embodiments, the side leg assembly includes a left leg, a right leg, a middle leg, and one or more lateral bars. The left leg is disposed at a left side of the foldable bed frame and pivotally coupled with the upper frame. The right leg is disposed at a right side of the foldable bed frame and pivotally coupled with the upper frame. The middle leg is disposed between the left and right legs and fixedly coupled with the left and right legs by the one or more lateral bars. In an exemplary embodiment, the middle leg is pivotally coupled with the upper frame.

In an exemplary embodiment, the second left or right link has a first end portion fixedly coupled with a middle portion of the left or right segment of the lower peripheral support, and a second end portion pivotally connected with a middle portion of the left or right leg of the side leg assembly.

In some exemplary embodiments, the middle link has a first end portion pivotally connected with the middle portion of the lateral segment of the lower peripheral support, and a second end portion pivotally connected with the middle leg or a lateral bar in the one or more lateral bars of the side leg assembly. In an exemplary embodiment, the first end portion of the middle link is pivotally connected with a first connecting piece fixedly coupled with the middle portion of the lateral segment of the lower peripheral support, and the second end portion of the middle link is pivotally connected with a second connecting piece fixedly coupled with the middle leg or the lateral bar in the one or more lateral bars of the side leg assembly.

In some exemplary embodiments, each of the first and second bedsteads further includes a left oblique support and a right oblique support. Each respective oblique support in the left and right oblique supports has a first end portion pivotally connected with the upper frame, and a second end portion slidably and rotatably connected with a corresponding leg in the left and right legs of the side leg assembly. The respective oblique support is slidable along a length direction of the corresponding leg to allow the corresponding leg fold and unfold with respect to the upper frame, and is selectively locked when the corresponding leg is unfolded thereby restricting the corresponding leg from rotating away from its unfolded position.

In various exemplary embodiments, the present invention provides a foldable bed frame including a first bedstead, a second bedstead, and a middle leg assembly disposed between the first and second bedsteads. Each of the first and second bedsteads includes an upper frame having a proximal side and a distal side, and a side leg assembly pivotally connected with the upper frame at the distal side of the upper frame. The middle leg assembly pivotally connects the proximal side of the upper frame of the first bedstead with the proximal side of the upper frame of the second bedstead. A respective bedstead in the first and second bedsteads further includes a lower peripheral support and a plurality of links. The lower peripheral support has a substantially "⊏" shape and includes a left segment, a right segment, and a lateral segment between the left and right segments. When the foldable bed frame is unfolded, the lower peripheral support is disposed below the upper frame with the lateral segment at the distal side of the upper frame, the left segment at a left side of the side leg assembly, and the right segment at a right side of the side leg assembly. The plurality of links includes a first left link, a second left link, a first right link, a second right link and a middle link. The first left link pivotally connects a free end portion of the left segment of the lower peripheral support with the upper frame. The second left link pivotally connects a middle portion of the left segment of the lower peripheral support with the side leg assembly. The first right link pivotally connects a free end portion of the right segment of the lower peripheral support with the upper frame. The second right link pivotally connects a middle portion of the right segment of the lower peripheral support with the side leg assembly. The middle link pivotally connects a middle portion of the lateral segment of the lower peripheral support with the side leg assembly.

In various exemplary embodiments, the present invention provides a foldable bed frame including first and second bedsteads, and a middle leg assembly disposed between the first and second bedsteads and pivotally connecting the first and second bedsteads. Each of the first and second bedsteads includes an upper frame, a side leg assembly, a left oblique support and a right oblique support. The upper frame has a proximal side and a distal side. The side leg assembly is disposed at the distal side of the upper frame, and includes a left leg and a right leg disposed at a left side and a right side of the foldable bed frame, respectively. Each of the left and right legs is pivotally connected with the upper frame. Each respective oblique support in the left and right oblique supports has a first end portion pivotally connected with the upper frame, and a second end portion slidably and rotatably connected with a corresponding leg in the left and right legs of the side leg assembly. The respective oblique support is slidable along a length direction of the corresponding leg to allow the corresponding leg fold and unfold with respect to the upper frame, and is selectively locked when the corresponding leg is unfolded thereby restricting the corresponding leg from rotating away from its unfolded position. The middle leg assembly pivotally connects the proximal side of the upper frame of the first bedstead with the proximal side of the upper frame of the second bedstead.

In some exemplary embodiments, the corresponding leg includes an elongated slot along a length direction thereof, wherein the second end portion of the respective oblique support is coupled with the elongated slot. In an exemplary embodiment, the elongated slot includes a curved lower end to facilitate the locking of the respective oblique support.

In some exemplary embodiments, each of the first and second bedsteads further includes a lower peripheral support and a plurality of links. The lower peripheral support has a substantially "⊏" shape and includes a left segment, a right segment, and a lateral segment between the left and right segments. When the foldable bed frame is unfolded, the lower peripheral support is disposed below the upper frame with the lateral segment at the distal side of the upper frame, the left segment at a left side of the left leg of the side leg assembly, and the right segment at a right side of the right leg of the side leg assembly. The plurality of links includes a first left link, a second left link, a first right link, and a second right link. The first left link pivotally connects a free end portion of the left segment of the lower peripheral support with the upper frame. The second left link pivotally connects a middle portion of the left segment of the lower peripheral support with the side leg assembly. The first right link pivotally connects a free end portion of the right segment of the lower peripheral support with the upper frame. The second right link pivotally connects a middle portion of the right segment of the lower peripheral support with the side leg assembly.

In some exemplary embodiments, the side leg assembly further includes a middle leg disposed between the left and right legs, and one or more lateral bars fixedly coupling the middle leg with the left and right legs. In an exemplary embodiment, each of the first and second bedsteads further includes a lower peripheral support and a plurality of links. The lower peripheral support has a substantially "⊏" shape and includes a left segment, a right segment, and a lateral segment between the left and right segments. When the foldable bed frame is unfolded, the lower peripheral support is disposed below the upper frame with the lateral segment at the distal side of the upper frame, the left segment at a left side of the side leg assembly, and the right segment at a right side of the side leg assembly. The plurality of links includes a first left link, a second left link, a first right link, a second right link and a middle link. The first left link pivotally connects a free end portion of the left segment of the lower peripheral support with the upper frame. The second left link pivotally connects a middle portion of the left segment of the lower peripheral support with the left leg of the side leg assembly. The first right link pivotally connects a free end portion of the right segment of the lower peripheral support with the upper frame. The second right link pivotally connects a middle portion of the right segment of the lower peripheral support with the right leg of the side leg assembly. The middle link pivotally connects a middle portion of the lateral segment of the lower peripheral support with the middle leg or a lateral bar in the one or more lateral bars of the side leg assembly.

The lower peripheral supports, the oblique supports, and foldable bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Figure 1:
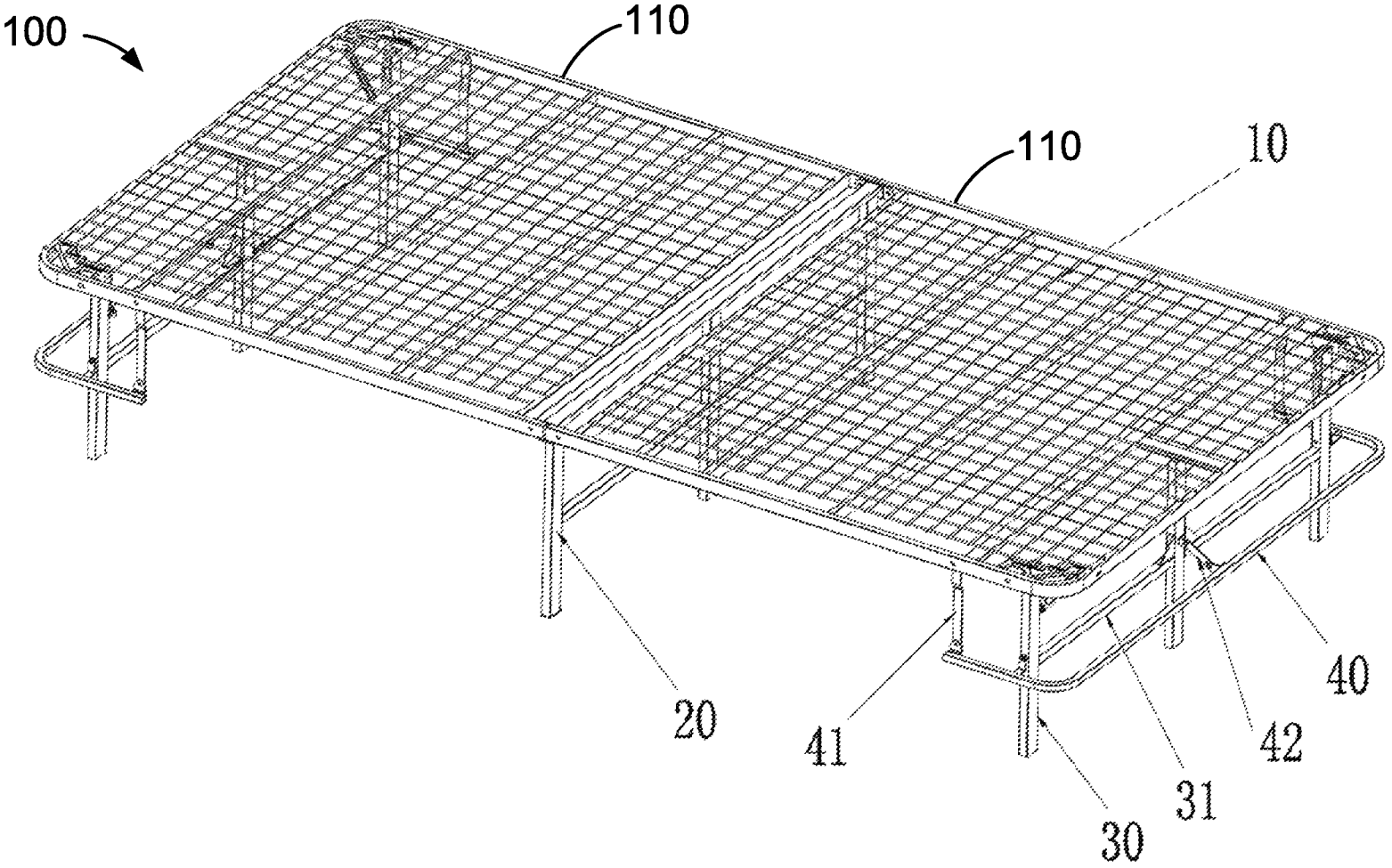
FIG. 1 is a perspective view illustrating an exemplary foldable bed frame in an unfolded state in accordance with exemplary embodiments of the present invention.

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable bed frames. The foldable bed frame can be of various sizes including but not limited to twin, full, queen and king sizes, and of various shapes including but not limited to rectangles and squares. They can be made of various materials including but not limited to metals such as steel, plastics and woods.

In general, a foldable bed frame of the present invention includes a plurality of pivotally connected bedsteads. The bedsteads in one foldable bed frame can be substantially the same as each other or different from each other. A typical bedstead includes an upper frame, and a side leg assembly pivotally connected with the upper frame. In many cases, a bedstead further includes a plurality of oblique supports each pivotally connected with the upper frame, and slidably and rotatably connected with the side leg assembly. In various cases, a bedstead further includes a substantially "⊏" shaped lower peripheral support connected with both the upper frame and the side leg assembly. The lower peripheral support can be folded and unfolded along with the upper frame and the side leg assembly, making the foldable bed frame of the present invention easy and convenient to use. In addition, the oblique supports and/or the lower peripheral support help to stabilize the foldable bed frame and prevent the bedsteads from shaking when in use.

Referring now to FIG. 1, there is depicted an exemplary foldable bed frame in accordance with some exemplary embodiments. By way of example, FIG. 1 illustrates exemplary foldable bed frame 100 including two bedsteads such as first and second bedsteads 110 pivotally connected with each other. Bedstead 110 includes an upper frame such as upper frame 10. The upper frame has a proximal side and a distal side. The proximal sides of the upper frames of the first and second bedsteads are pivotally connected with each other, for example, through a middle leg assembly such as middle leg assembly 20 as illustrated in FIG. 1. In an embodiment, the proximal side of each upper frame is pivotally connected with middle leg assembly 20.

As used herein, the sides at which the upper frames of the first and second bedsteads are connected with each other are referred to as their proximal sides, and the sides opposite the proximal sides are referred to as their distal sides. For instance, in FIG. 1, the proximal sides of the upper frames are in the middle of the foldable bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame.

In various embodiments, bedstead 110 also includes a side leg assembly such as side leg assembly 30 pivotally connected with upper frame 10 at the distal side of upper frame 10. In many embodiments, side leg assembly 30 includes left and right legs 33 disposed at the left and right sides of the foldable bed frame, respectively, and pivotally coupled with upper frame 10 (e.g., the upper end of the leg is pivotally coupled with the upper frame). In some embodiments, side leg assembly 30 also includes a middle leg such as middle leg 32 disposed between the left and right legs. The left, middle and right legs are fixedly coupled with each other by one or more lateral bars 31. In some embodiments, the middle leg is also pivotally coupled with the upper frame.

In some embodiments, bedstead 110 further includes one or more oblique supports each pivotally connected with the upper frame and slidably and rotatably connected with the side leg assembly. Each oblique support can be selectively locked at certain position(s), for instance, when the side leg assembly is unfolded, to restrict the side leg assembly from rotating toward or away from the upper frame. As a result, it helps to stabilize the foldable bed frame when in use.

Figure 2:
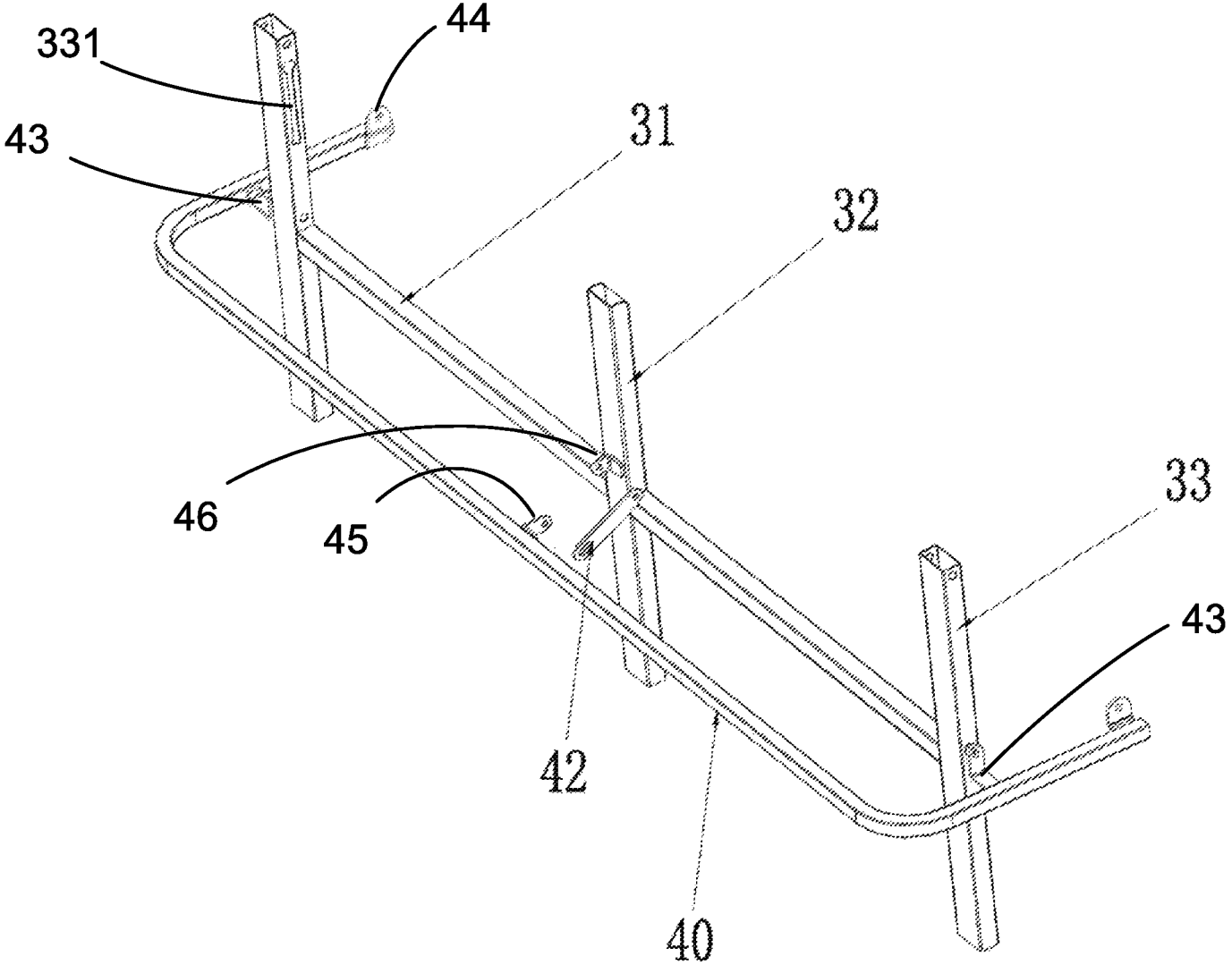
FIG. 2 is a partially disassembled view illustrating some components of the foldable bed frame of FIG. 1.
Figure 3:
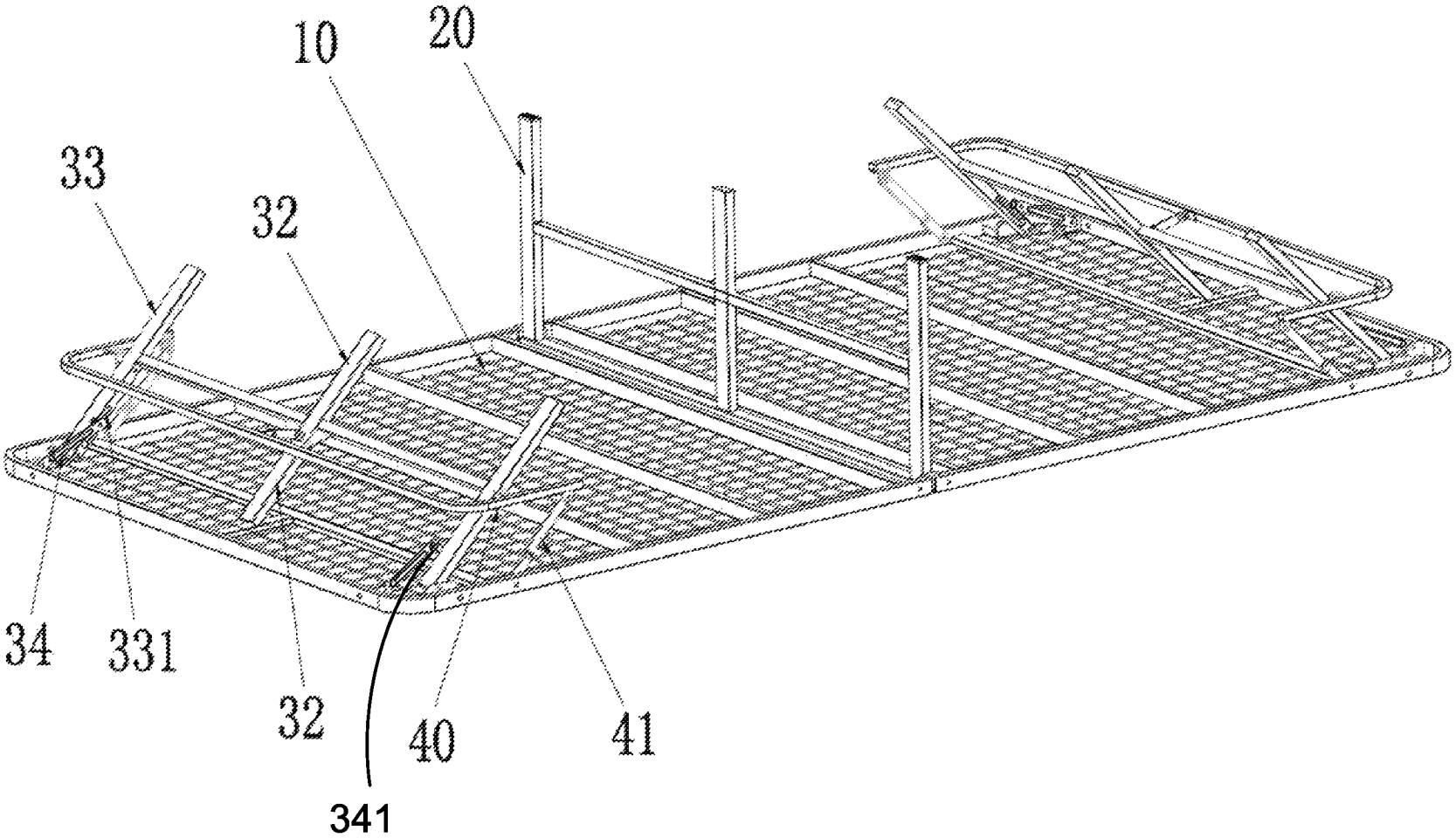
FIG. 3 is a perspective view illustrating the foldable bed frame of FIG. 1 in a first partially folded state.

By way of example, FIGS. 2 and 3 illustrate oblique support 34 having a first end portion pivotally connected with the upper frame and a second end portion slidably and rotatably connected with the side leg assembly. In some embodiments, the left or right leg of the side leg assembly is formed with an elongated slot such as slot 331 along a length direction of the leg, and oblique support 34 includes a coupling piece such as coupling piece 341 formed or fixed (e.g., welded) at the second end portion of oblique support 34. Coupling piece 341 can be a knob, a rivet, a protrusion, a pin or the like. Coupling piece 341 is received in the elongated slot and slidable along the elongated slot or a portion of the elongated slot, thus allowing the left or right leg of the side leg assembly to fold and unfold with respect to the upper frame. Generally, coupling piece 341 remains in the elongated slot while folding and unfolding of the bed frame.

In some embodiments, when coupling piece 341 is positioned at an end of the elongated slot (e.g., the lower end of the slot in FIG. 2), the corresponding left or right leg is completely unfolded with respect to the upper frame as illustrated in FIG. 1. In an embodiment, the lower end of elongated slot 331 is curved (e.g., formed with a partially circular end) to engage with coupling piece 341 when it reaches the lower end. The engagement automatically locks the second end portion of oblique support 34 and prevents it from sliding upward along the slot, thereby restricting the corresponding left or right leg (or the side leg assembly) from rotating away from its unfolded position. A gentle press of the second end portion of oblique support 34 releases the engagement of the coupling piece with the lower end of the elongated slot. After disengagement, the coupling piece can slide along the elongated slot, thereby allowing the corresponding left or right leg (or the side leg assembly) to fold and unfold.

It should be noted that a bedstead can include one, two, or more oblique supports. For instance, a bedstead can include an additional oblique support coupling the middle leg of the side leg assembly with the upper frame. It should also be noted that two bedsteads of the same bed frame can include different numbers of oblique supports. For instance, one bedstead can include two oblique supports while the other bedstead can include three oblique supports.

In various embodiments, bedstead 110 further includes a lower support such as lower peripheral support 40. Lower peripheral support 40 includes a left segment, a right segment, and a lateral segment between the left and right segments, which collectively forms a substantially "⊏" shape. When the foldable bed frame is unfolded, lower peripheral support 40 is disposed below the upper frame with the lateral segment at the distal side of the upper frame, the left segment at the left side of the side leg assembly, and the right segment at the right side of the side leg assembly. In other words, lower peripheral support 40 encompasses the side leg assembly (e.g., when viewed from the top of the bed frame) with the opening of the "⊏" shape facing toward the proximal side of the upper frame. In an embodiment, the lower peripheral support is made of a bent bar.

Lower peripheral support 40 is connected with the upper frame and the side leg assembly through a plurality of links. For instance, FIGS. 1 and 2 illustrate lower peripheral support 40 connected with the upper frame through first left and right links 41. In various embodiments, first left link 41 pivotally connects the free end portion of the left segment of lower peripheral support 40 with the upper frame. In some embodiments, the first left link has a first end portion pivotally connected with the free end portion of the left segment of lower peripheral support 40, and a second end portion pivotally connected with a left edge of the upper frame. In an embodiment, the first end portion of the first left link is pivotally connected with a connecting piece such as connecting piece 44, which is fixedly coupled (e.g., welded) with the free end portion of the left segment of lower peripheral support 40. Connecting piece 44 can be a link, a bracket, or a piece with any suitable configuration.

Similarly, in various embodiments, first right link 41 pivotally connects the free end portion of the right segment of lower peripheral support 40 with the upper frame. In some embodiments, the first right link has a first end portion pivotally connected with the free end portion of the right segment of lower peripheral support 40, and a second end portion pivotally connected with a right edge of the upper frame. In an embodiment, the first end portion of the first right link is pivotally connected with a connecting piece such as connecting piece 44, which is fixedly coupled with the free end portion of the right segment of lower peripheral support 40.

In some embodiments such as those illustrated in FIGS. 1 and 2, lower peripheral support 40 is also connected with the side leg assembly through middle link 42 and second left and right links 43. Middle link 42 pivotally connects the middle portion of the lateral segment of lower peripheral support 40 with the side leg assembly, and second left and right links 43 pivotally connect the middle portions of the left and right segments of lower peripheral support 40 with the side leg assembly, respectively.

In some embodiments, middle link 42 has a first end portion pivotally connected with the middle portion of the lateral segment of lower peripheral support 40, and a second end portion pivotally connected with the middle leg or a lateral bar of the side leg assembly. In an embodiment, the first end portion of the middle link is pivotally connected with a first connecting piece such as connecting piece 45 fixedly coupled with the middle portion of the lateral segment of lower peripheral support 40, and the second end portion of the middle link is pivotally connected with a second connecting piece such as connecting piece 46 fixedly coupled with the middle leg or the lateral bar of the side leg assembly. Like connecting piece 44, connecting pieces 45 and 46 can have any suitable configurations including but not limited to a link and a bracket.

In some embodiments, second left link 43 has a first end portion fixedly coupled with the middle portion of the left segment of lower peripheral support 40, and a second end portion pivotally connected with the middle portion of the left leg of the side leg assembly. Similarly, in some embodiments, second right link 43 has a first end portion fixedly coupled with the middle portion of the right segment of lower peripheral support 40, and a second end portion pivotally connected with the middle portion of the right leg of the side leg assembly.

In some embodiments, the lower peripheral support is disposed at the head or foot section of foldable bed frame 100. In some embodiments, foldable bed frame 100 includes two lower peripheral supports, one at the head section and the other at the foot section. When the bed frame is unfolded and in use, the lower peripheral support can be used to support a bed cloth such as bed coverings, bed linens, bed sheets and bed blankets, in particular along the sides of the bed frame so that the bed cloth does not hang down loosely. Accordingly, it helps to maintain the bed cloth straight, tight and/or smooth, and thus improves the appearance of the bed.

Figure 4:
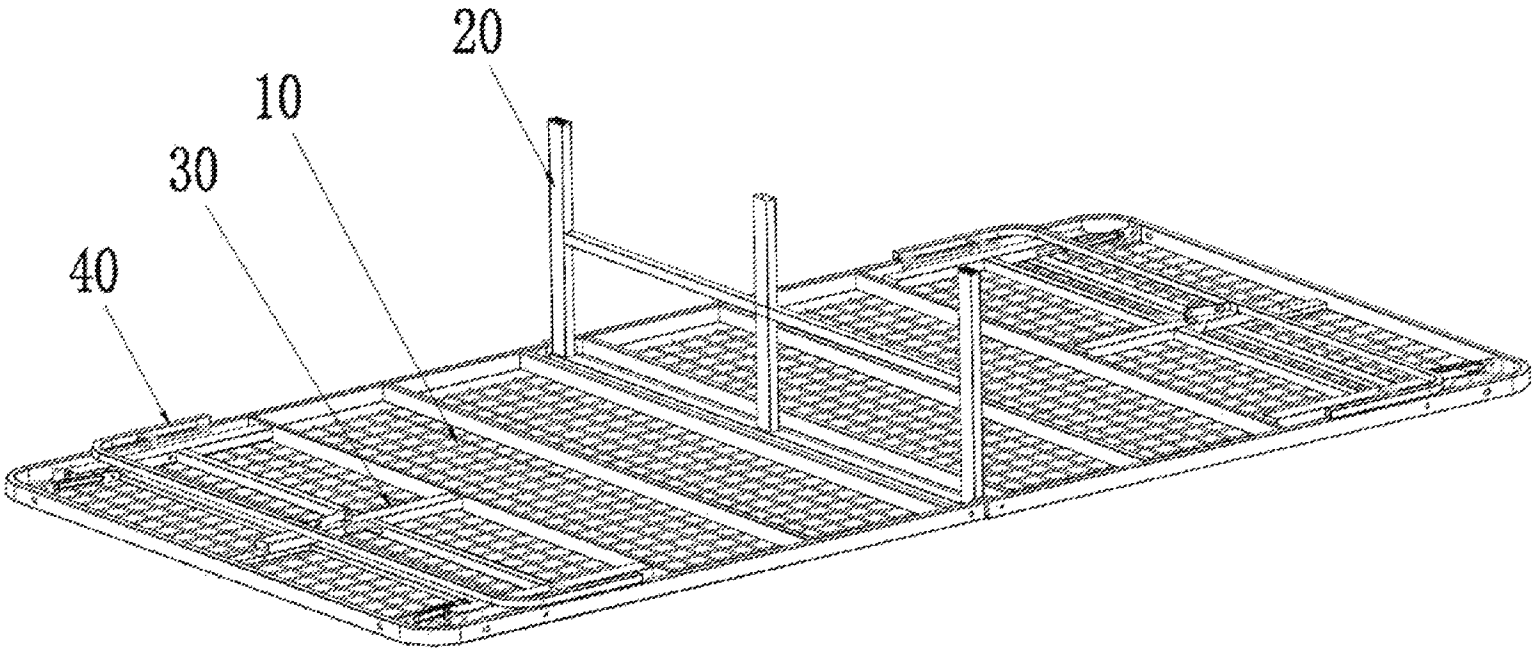
FIG. 4 is a perspective view illustrating the foldable bed frame of FIG. 1 in a second partially folded state.

The bed frame of the present invention is stable, and easy and convenient to use. For instance, to fold the bed frame, gently press the second end portion of oblique support 34 to disengage the coupling piece from the curved lower end of the slot and then push the leg (or the side leg assembly) toward the proximal side of the upper frame. While the leg (or the side leg assembly) is rotating toward the upper frame, the coupling piece is sliding along the elongated slot until the leg (or the side leg assembly) is completely folded onto the upper frame as illustrated in FIG. 4. To unfold the bed frame, simply rotate the leg (or the side leg assembly) away from the upper frame until the coupling piece reaches the lower end of the slot, at which the coupling piece automatically engages with the lower end of the slot, thereby locking the oblique support and consequently restricting the leg (or the side leg assembly) from rotating away from its unfolded position. In some cases, engagement of the coupling piece with the lower end of the slot generates an indicative sound.

It should be noted that the lower peripheral supports and the oblique supports of the present invention can be used in a variety of foldable bed frames and foldable beds. Also, it should be noted that the lower peripheral supports and the oblique supports of the present invention can work independently, e.g., a foldable bed frame of the present invention does not necessarily need to have both the lower peripheral support and the oblique support of the present invention. For instance, it can include a lower peripheral support of the present invention but not an oblique support of the present invention, or vice versa. It can also include a lower peripheral support of the present invention, along with any other suitable supports.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bedstead could be termed a second bedstead, and, similarly, a second bedstead could be termed a first bedstead, without changing the meaning of the description, so long as all occurrences of the "first bedstead" are renamed consistently and all occurrences of the "second bedstead" are renamed consistently.

What is claimed is:

1. A foldable bed frame comprising:

first and second bedsteads, each comprising:

an upper frame having a proximal side and a distal side;

a side leg assembly pivotally connected with the upper frame at the distal side thereof;

a lower peripheral support having a substantially "⊏" shape and comprising a left segment, a right segment, and a lateral segment between the left and right segments, wherein when the foldable bed frame is unfolded, the lower peripheral support is disposed below the upper frame with the lateral segment at the distal side of the upper frame, the left segment at a left side of the side leg assembly, and the right segment at a right side of the side leg assembly;

a first left link pivotally connecting a free end portion of the left segment of the lower peripheral support with the upper frame;

a second left link pivotally connecting a middle portion of the left segment of the lower peripheral support with the side leg assembly;

a first right link pivotally connecting a free end portion of the right segment of the lower peripheral support with the upper frame;

a second right link pivotally connecting a middle portion of the right segment of the lower peripheral support with the side leg assembly; and a middle link pivotally connecting a middle portion of the lateral segment of the lower peripheral support with the side leg assembly; and a middle leg assembly disposed between the first and second bedsteads and pivotally connecting the proximal side of the upper frame of the first bedstead with the proximal side of the upper frame of the second bedstead.

2. The foldable bed frame of claim 1, wherein each of the first and second bedsteads further comprises:

one or more oblique supports, each having a first end portion pivotally connected with the upper frame, and a second end portion slidably and rotatably connected with the side leg assembly, wherein each oblique support is selectively locked at a position thereby restricting the side leg assembly from rotating with respect to the upper frame.

3. The foldable bed frame of claim 1, wherein the proximal side of the upper frame of each bedstead is pivotally connected with the middle leg assembly.

4. The foldable bed frame of claim 1, wherein the first left or right link has a first end portion pivotally connected with the free end portion of the left or right segment of the lower peripheral support, and a second end portion pivotally connected with a left or right edge of the upper frame.

5. The foldable bed frame of claim 4, wherein the first end portion of the first left or right link is pivotally connected with a connecting piece fixedly coupled with the free end portion of the left or right segment of the lower peripheral support.

6. The foldable bed frame of claim 1, wherein the side leg assembly comprises:

a left leg disposed at a left side of the foldable bed frame and pivotally coupled with the upper frame;

a right leg disposed at a right side of the foldable bed frame and pivotally coupled with the upper frame;

a middle leg disposed between the left and right legs; and one or more lateral bars fixedly coupling the middle leg with the left and right legs.

7. The foldable bed frame of claim 6, wherein the second left or right link has a first end portion fixedly coupled with a middle portion of the left or right segment of the lower peripheral support, and a second end portion pivotally connected with a middle portion of the left or right leg of the side leg assembly.

8. The foldable bed frame of claim 6, wherein the middle link has a first end portion pivotally connected with the middle portion of the lateral segment of the lower peripheral support, and a second end portion pivotally connected with the middle leg or a lateral bar in the one or more lateral bars of the side leg assembly.

9. The foldable bed frame of claim 8, wherein the first end portion of the middle link is pivotally connected with a first connecting piece fixedly coupled with the middle portion of the lateral segment of the lower peripheral support, and the second end portion of the middle link is pivotally connected with a second connecting piece fixedly coupled with the middle leg or the lateral bar in the one or more lateral bars of the side leg assembly.

10. The foldable bed frame of claim 6, wherein the middle leg is pivotally coupled with the upper frame.

11. The foldable bed frame of claim 6, wherein each of the first and second bedsteads further comprises:

a left oblique support and a right oblique support, each respective oblique support in the left and right oblique supports having a first end portion pivotally connected with the upper frame, and a second end portion slidably and rotatably connected with a corresponding leg in the left and right legs of the side leg assembly, wherein the respective oblique support is slidable along a length direction of the corresponding leg to allow the corresponding leg fold and unfold with respect to the upper frame, and is selectively locked when the corresponding leg is unfolded thereby restricting the corresponding leg from rotating away from its unfolded position.

12. A foldable bed frame comprising:

first and second bedsteads, each comprising an upper frame having a proximal side and a distal side, and a side leg assembly pivotally connected with the upper frame at the distal side thereof; and a middle leg assembly disposed between the first and second bedsteads and pivotally connecting the proximal side of the upper frame of the first bedstead with the proximal side of the upper frame of the second bedstead, wherein a respective bedstead in the first and second bedsteads further comprises:

a lower peripheral support having a substantially "⊏" shape and comprising a left segment, a right segment, and a lateral segment between the left and right segments, wherein when the foldable bed frame is unfolded, the lower peripheral support is disposed below the upper frame with the lateral segment at the distal side of the upper frame, the left segment at a left side of the side leg assembly, and the right segment at a right side of the side leg assembly;

a first left link pivotally connecting a free end portion of the left segment of the lower peripheral support with the upper frame;

a second left link pivotally connecting a middle portion of the left segment of the lower peripheral support with the side leg assembly;

a first right link pivotally connecting a free end portion of the right segment of the lower peripheral support with the upper frame;

a second right link pivotally connecting a middle portion of the right segment of the lower peripheral support with the side leg assembly; and a middle link pivotally connecting a middle portion of the lateral segment of the lower peripheral support with the side leg assembly.

* * * * *